United States Patent [19]

Mays

[11] Patent Number: 4,825,944

[45] Date of Patent: May 2, 1989

[54] GRAVEL PACK COMPLETION FOR IN SITU LEACH WELLS

[75] Inventor: Wallace M. Mays, Corpus Christi, Tex.

[73] Assignee: Everest Minerals Corp., Corpus Christi, Tex. ; a part interest

[21] Appl. No.: 549,619

[22] Filed: Nov. 7, 1983

[51] Int. Cl.[4] ..... E21B 43/04; E21B 43/10

[52] U.S. Cl. ..... 166/51; 166/158

[58] Field of Search ..... 166/278, 51, 276, 157, 166/158

[56] References Cited

U.S. PATENT DOCUMENTS

| | | | |
|---|---|---|---|
| 2,167,190 | 7/1939 | Vietti | 166/278 |
| 2,187,895 | 1/1940 | Sanders | 166/276 |
| 2,205,119 | 6/1940 | Hall et al. | 166/376 |
| 2,652,117 | 9/1953 | Arendt et al. | 166/278 |
| 2,693,854 | 11/1954 | Abendroth | 166/278 |
| 2,978,024 | 4/1961 | Davis | 166/278 |
| 3,107,727 | 10/1963 | Howard | 166/276 |
| 3,559,736 | 2/1971 | Bombardieri | 166/276 |
| 3,627,046 | 12/1971 | Miller et al. | 166/278 |
| 3,850,246 | 11/1974 | Despujols | 166/278 |
| 4,440,218 | 4/1984 | Farley | 166/51 |

*Primary Examiner*—Hoang C. Dang

[57] ABSTRACT

A method and apparatus for completing an in situ leach well to prevent production of sand and to insure minimum permeability damage to the ore bearing zone during casing and cementing operations. A hole for the casing is drilled to and terminated at a point (e.g. one-foot) just above the ore zone. If a pilot hole has been drilled to locate the ore zone, it is reamed to provide the hole for the casing with the cuttings from the reaming operations dropping into lower portion of the pilot hole which extends through the ore zone, thereby protecting the ore zone from permeability damage normally cause by contact with cement. The hole is then cased and cemented. Next, a hole is drilled from the lower end of the casing into the ore zone and an interval thereof is underreamed. A perforated liner is lowered on a drill stem which has a stinger pipe thereon which extends through the lower end of the liner. Gravel is then pumped down the drill stem and out the stinger pipe to fill the underreamed interval around the liner. The drill stem is then raised to position the stinger pipe within the liner and water is circulated to wash the liner. The drill stem and stinger pipe is then removed.

3 Claims, 1 Drawing Sheet

GRAVEL PACK COMPLETION FOR IN SITU LEACH WELLS

TECHNICAL FIELD

The present invention relates to a method and apparatus for completing a well and more particularly relates to a method and apparatus for gravel packing a well, which is to be a well used in the in situ leaching of a mineral, e.g. uranium.

BACKGROUND OF THE INVENTION

In a typical in situ leach operation, wells are completed into a mineral or metal value bearing (e.g. uranium) formation and a lixiviant is flowed between injection and production wells. The uranium and/or related values are dissolved into the lixiviant and are produced therewith to the surface where the pregnant lixiviant is treated to recover the desired values.

In developing such a leach operation, several factors must be considered in order for the operation to be a commercial success. One of the most important but often overlooked consideration is the manner in which the injection and/or production wells are completed into the ore bearing formation. Improperly completed wells may lead to an early abandonment of an operation which might have otherwise had a long production life. For example, in many leach operations, a large volume of sand or other particulate material becomes entrained with the lixiviant as it passes through the formation and is produced therewith. As recognized in the art, this entrained sand is highly detrimental to production equipment such as down hole pumps and often leads to high maintenance costs and costly delays in production. Also, this sand has to be separated from the lixiviant and disposed at the surface of thereby substantially increasing the overall costs of the leach operation.

It has long been known that the problems of sand production can be alleviated by "gravel packing" the production interval of the well. There are several known types of gravel pack completion techniques. One involves casing the well through the formation, setting a screen or slotted liner adjacent the production formation and then placing gravel behind the casing (see U.S. Pat. No. 3,353,599). Another involves drilling a hole through the formation, casing the hole down to the formation, underreaming the formation and then either setting the screen and placing gravel around the screen (see U.S. Pat. No. 4,192,375) or first placing the gravel and then washing the screen into place (see U.S. Pat. No. 3,362,475). However, in all of these techniques, the well is drilled all the way through the production formation before the casing is set and cemented in place. This exposes the production formation to the cement and cement water during the casing operation which may seriously damage the permeability of the formation which, in turn, adversely affects the injection and/or production flowrates into or out of the formation during a leach operation.

Further, in a leach operation, it is extremely important to limit as close as possible the vertical injection and production intervals in the injection and production wells, respectively, to the actual ore bearing zone. This insures the most desirable flowpath between the wells for the lixiviant thereby preventing undue migration and/or loss of the lixiviant as it flows through the one zone. Therefore, it is vital that the screen in a gravel pack completion be adjacent these respective intervals in the respective wells.

DISCLOSURE OF THE INVENTION

The present invention provides a method and apparatus for completing a well of the type used in an in situ leach operation wherein the well is gravel packed to prevent the production of sand without the ore bearing zone ever being exposed to permeablity damage normally caused by exposure to the cement used in casing the well. Also, the perforated liner, e.g., screen, used with the gravel pack is accurately positioned adjacent the ore bearing interval within the well thereby establishing the best possible flowpath for the lixiviant between injection and production wells. Further, the apparatus of the present invention which is used to complete a well is constructed (1) so that all portions which can not be readily drilled out, if such a need arises, are easily recoverable; and (2) so that the completion equipment can be easily cleaned, recovered, and reset without damage to the cased well.

More specifically, in completing a well in accordance with the present invention, a relatively small pilot hole is drilled from the surface through the production formation, (e.g. uranium ore bearing zone) through which the well is logged to accurately locate the ore bearing zone. If the location of this zone is already known from previous nearby drilling, this step is not necessary.

Next, a larger hole is drilled to a point a short distance (e.g. one foot) above the top of the ore bearing zone. This hole can be drilled be reaming the pilot hole if one has been previously drilled. The cuttings from the reaming operations will fall into and plug that portion of the pilot hole which extends through the ore bearing zone. Casing is then run into the hole and cemented in place. By stopping the short distance above the ore zone and plugging the reamining portion of the pilot hole with cuttings, the remaining overburden, which overlies the ore zone and the cuttings will protect the ore zone from permeabilty damage during cementing of the casing.

After the cement hardens, a drill is lowered through the casing and the cement remaining in the casing is drilled out and a hole is drilled from the bottom of the casing through the ore zone and to a distance, e.g. two feet, therebelow. An interval of the hole below the casing is underreamed to a diameter substantially greater than the casing diameter from a point, e.g. one to two feet, above the ore zone to a point, e.g. one foot, below.

Using the apparatus of the present invention, a perforate liner having the desired dimensions is lowered on a drill stem and positioned in the underreamed interval adjacent the one zone. Knowing the diameter and length of the underreamed interval, the volume of a desired-sized gravel is calculated which will be needed to completely fill the annulus between the perforated liner and the wall of the underreamed hole wall. This volume of gravel is added to water and is pumped down through the drill stem to a stinger pipe which extends out through the lower end of the perforated liner. The water deposits the gravel around the perforated liner, and then flows through the perforate liner to return to the surface through the annulus formed between the drill stem and the casing. When the annulus between the perforated liner and the underreamed hole is completely filled with gravel, there will be an increase in pump pressure and a decrease in water flow.

The stinger pipe is then raised so its lower end will lie within the perforated liner and water is circulated therethrough to clean the perforated liner. The drill stem and stinger pipe is then removed, leaving the perforated liner and the surrounding gravel pack in place. The well is now completed. It has been found that in situ leach wells completed in accordance with the present invention have flow and production capacities of 2 to 3 times those completed with previous known techniques thereby requiring fewer wells to be used in producing a particular ore deposit.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
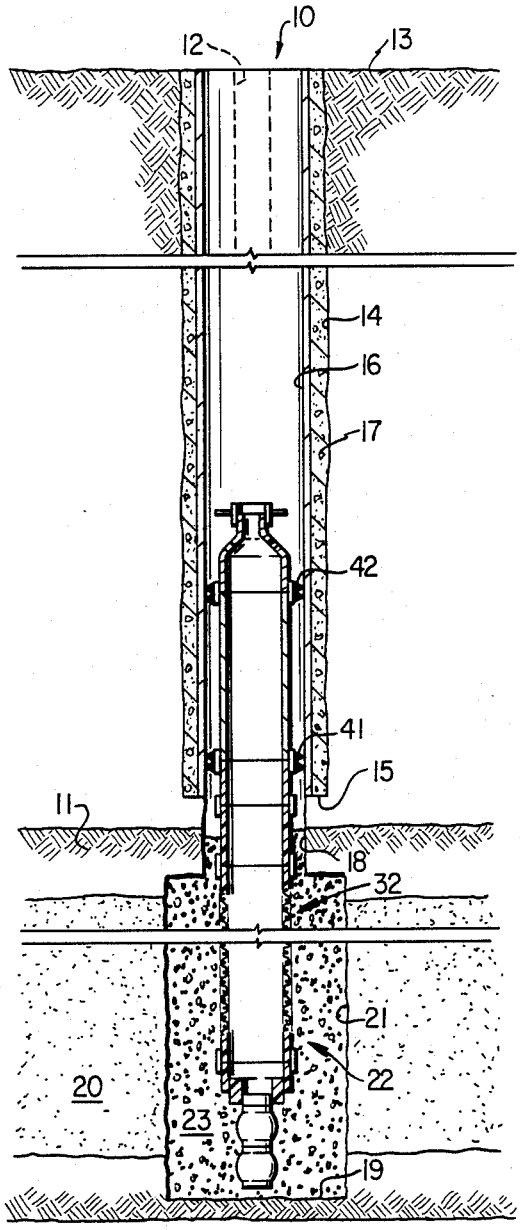
FIG. 1 is a cross-sectional view of a well completed in accordance with the present invention.

Referring more particularly to the drawings, FIG. 1 discloses a well 10 completed in accordance with the present invention. Well 10 as shown, is either an injection well or a production well of the type used to inject a lixiviant into a formation and produce same, respectively, after it has passed through a production formation, e.g., an ore bearing formation, and has leached a desired mineral (e.g. uranium) therefrom.

If the exact location (i.e. depth and thickness) of ore-bearing formation 11 is not known from previous drilling and logging data in the proximate area of well 10, a pilot hole 12 (shown only by dotted lines 12 in upper portion of well 10) is drilled from the surface 13 down through formation 11. Pilot hole 12 is of a small diameter (e.g. 4 to 5 inches), just large enough to permit the lowering of the necessary equipment to accurately log formation 11. If the location and dimensions of formation 11 are already established from previous logged, nearby wells, no pilot hole will need to be drilled.

Next, hole 14 is drilled from surface 13 to and terminated at a point 15 which is a short distance (e.g. 1 foot) above the top of formation 11. Since casingn is to be set through the entire length of hole 14, the diamater of hole 14 should be larger (e.g. by two inches) than the diameter (e.g. 5 to 6 inches) of the casing to be run to provide for good cementing between the walls of hole 14 and the casing. Good cementing is important in a well used for leaching in order to protect overlyling aquifier formations from upward migration of lixiviant. If a pilot hole 12 has been drilled, hole 14 is formed by reaming the pilot hole. The cuttings from the reaming operations will fall into the lower portion of the pilot hole and will plug and seal that portion of pilot hole 12 which extends through formation 11.

Casing 16, having a diameter (e.g. 5 to 6 inches) large enough to allow a downhole pump and/or workover tools to be passed therethrough is lowered into hole 14. Casing 16 is then cemented in place, preferably by pumping cement 17 down through casing 16, out the bottom thereof, and up through the annulus between casing 16 and hole 14. Excess cement should be used so that some will remain in the bottom of casing 16 to insure a good cement job around the lower end of casing 16. It can be seen that stopping hole 14 above formation 11 and plugging pilot hole 12 (if one is drilled), there will be no permeability damage to ore zone 20 during cementing operations.

After cement 17 hardens, a drill having a slightly smaller diameter than that of casing 16 is lowered through casing 16 and the cement remaining in the casing is drilled out. Drilling is continued to form hole 18 which extends a point 19 a short distance (e.g. 2 feet) below ore zone 20 (i.e. interval to be screened). Next, hole 18 is underreamed from a point just above (e.g. 1 to 2 feet) ore zone 20 to a point just below (e.g. 1 foot). The diameter (e.g. 11 inches) of underreamed hole 21 is substantially greater than the diameter of casing 16.

Next, perforated liner 22 is lowered into underreamed hole 21 and is positioned adjacent ore zone 20. As used herein, "perforated liner" is intended to include well screens, slotted liners, perforated liners, and all practical equivalents. The size and shape of the fluid flow apertures in the perforate liner for a particular well are selected according to factors well known in the art, e.g. size of the particulate material being produced and the size of the gravel to be used to form the gravel pack.

Knowing the dimensions of hole 21, the volume of gravel which will be required to fill the annulus between perforated liner 22 and wall of hole 21 can be calculated. This volume of gravel 23 is added to a carrier liquid, e.g. water, and is deposited around perforated liner 20 to fill the annulus in hole 21 to thereby complete well 10.

Figure 2:
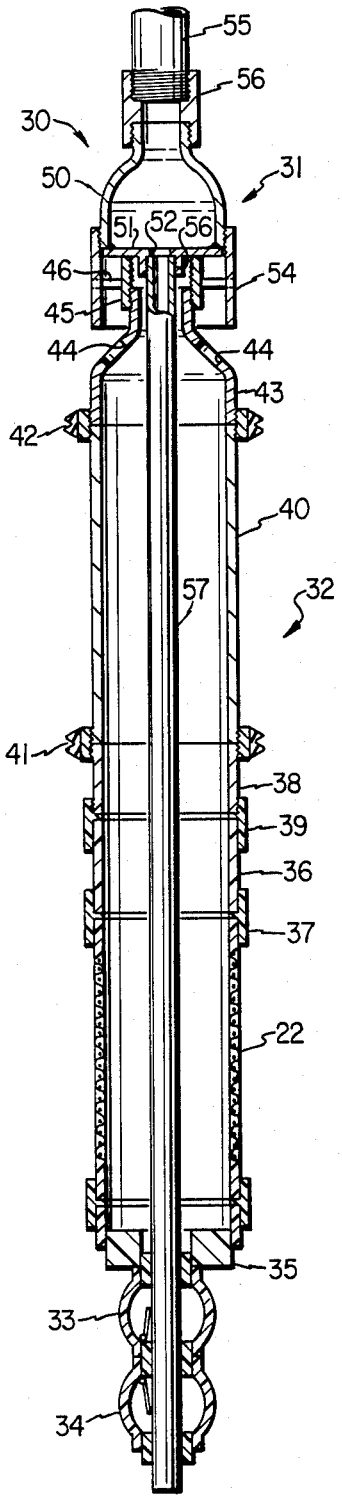
FIG. 2 is a cross-sectional view of the apparatus of the present invention.

Turning now to FIG. 2, apparatus 30 of the present invention which is used to complete well 10 is disclosed. Apparatus 30 is comprised of stinger pipe assembly 31 and perforated liner assembly 32.

Perforated liner assembly 32 is comprised of perforate liner 22. As stated above, perforated liner 22 (preferably a plastic well screen) is selected according to known, standard gravel packing calculations. Screen 22 is long enough to just extend over the interval of ore zone 20 and has a diameter of one inch or smaller than the diameter of casing 16. Check valves 33, 34 are coupled to the lower end of screen 22 by slip fittings 35. Check valves 33, 34 are of the "flapper" type with valve 33 being normally closed to downward flow while valve 34 being normally closed to upward flow. A slip nipple 36 is coupled by slip collar 37 to the upper end of screen 22 and, in turn, is coupled at its other end to threaded nipple 38 by slip to threaded collar 39.

Spacer pipe 40 is connected to nipple 38 by means of a threaded, steel-backed, rubber packer 41 (e.g. Model FIG. "K" packer, distributed by Johnson Well Screen). Pipe 40 is of a length sufficient to lie at least partially within casing 16 when screen 22 lies adjacent ore zone 20. Preferably, pipe 40 is of steel (1) to provide weight to prevent the subsequent pumping of perforated liner assembly 32 out of position in well 10 and (2) to connect the packers which are steel-backed so that all steel parts of said assembly are connected for recovery.

A second steel-backed, rubber packer 41 connects the upper end of pipe 40 to a swedge nipple 43 which has circulation openings 44 there through. Lower packer 41 is positionied so it will lie just inside casing 16 when screen 22 is in position to prevent the gravel from entering the casing, and possibly sticking assembly 32. J collar 45 having lugs 46 thereon is threaded onto nipple 43. Preferably, all parts below collar 39 are constructed of polyvinylchloride (PVC) or similar plastic material while collar 39 and all parts above are steel. This allows all of the steel portions to be recovered from well 10 if it becomes necessary to replace screen 22 or to workover the well. By being plastic, should screen 22 be pulled apart during recovery, it and check valves 33, 34 and related fittings (all plastic) can easily be drilled out of the well.

Stinger pipe assembly 31 is comprised swedge nipple 50 having plate 51 with opening 52 therethrough welded across the bottom thereof. Collar 54 is welded to nipple 50 and has J-slots (not shown) cut in the internal walls thereof. Collar 54 is adapted to be connected to drill stem 55 by sub 56. Welded to the underside of plate 51 and aligned with opening 51 is threaded collar 56 to which in turn,is threaded stinger pipe 57.

When apparatus 31 is assembled,the flappers of check valves 33, 34 are opened and stringer pipe 57 is lowered through assembly 32 and extends out the bottom of assembly 32 as shown if FIG. 2. Pipe 57 holds the flappers of valve 33,34 in an open position. The lugs 46 of J collar 45 cooperate with the J slots in collar 54 to releasebly secure assemblies 31, 32 together. This connection is the same as used in standard overshot J-tools and is well known and understood in the art. Apparatus 31 is now ready to complete well 10. It is lowered to position on drill stem 55 which will normally have a float valve (not shown) therein to prevent back flow.

Water is then pumped down drill stem 55 and out through stinger pipe 57. The water will flow back through screen 22, openings 44, and back up through casing 16 to the surface. Gravel 23 (properly sized in relation to produced sand size and screen opening size) is slowly added to the water and is pumped therewith into hole 21 through stringer pipe 57 until hole 21 around screen 22 is completely filled. This will be indicated by an increase in pump pressure and a decrease in water flow at which time pumping is stopped.

Drill stem 55 is then manipulated to un "J" assembly 31 which is then raised until the lower end of stinger pipe 57 lies within screen 22. As pipe 57 is withdrawn, the spring-based flappers of valves 33, 34 will close, thereby sealing the lower end of screen 22. By having valve 33 open upward and valve 34 open downward, there is less chance of sand fouling these valves. Water is then circulated to wash out any gravel that may be inside screen 22 and to clean screen 22. Assembly 31 is then removed and well 10 is completed.

What is claimed is:

1. An apparatus for completing a well comprising:

a perforated liner;

a first check valve means connected to the lower end of said perforated liner, said first check valve means normally closed to downward flow;

a second check valve means connected to said first check valve means, said second check valve normally closed to upward flow;

a spacer pipe attached to the upper end of said perforated liner; and packer means on said spacer pipe; and a stinger pipe assembly comprising:

a stinger pipe having a continous bore therethrough and being of a sufficient length to extend completely through said perforated liner and both said first and second check valves means and from the lower end thereof;

said first and second check valves means being held in an open position by said stinger pipe when said pipe is positioned through said check valve means and adapted to close when said stinger pipe is withdrawn therefrom;

means adapted to connect said stinger pipe to a drill stem;

whereby flow from the drill stem will flow through said stinger pipe and out below said liner; and means for releasably connecting said perforated liner assembly and said stinger pipe assembly together.

2. The apparatus of claim 1 wherein said releasable connecting means comprises:

means on the upper end of said spacer pipe having lugs thereon; and means on stinger pipe assembly having J slots which receive said lugs.

3. The apparatus of claim 2 wherein said perforated liner and said check valve means are comprised of a plastic material and said spacer pipe is comprised of steel.

* * * * *